US008167448B1

(12) United States Patent
Borrows

(10) Patent No.: US 8,167,448 B1
(45) Date of Patent: May 1, 2012

(54) STRUCTURE TO SUPPORT, DISPLAY AND ILLUMINATE A BASEBALL CAP

(76) Inventor: David Borrows, Boynton Beach, FL (US)

( * ) Notice: Subject to any disclaimer, the term of this patent is extended or adjusted under 35 U.S.C. 154(b) by 571 days.

(21) Appl. No.: 12/245,031

(22) Filed: Oct. 3, 2008

(51) Int. Cl.
*F21V 8/00* (2006.01)

(52) U.S. Cl. ..... 362/106; 362/806

(58) Field of Classification Search ..... 362/106, 362/249.01, 249.02, 249.04, 249.08, 249.16, 362/353, 410, 413, 418, 431, 448, 449, 806
See application file for complete search history.

(56) References Cited

U.S. PATENT DOCUMENTS

| | | | | | |
|---|---|---|---|---|---|
| D246,934 | S | * | 1/1978 | Keller | D26/73 |
| D288,725 | S | * | 3/1987 | Fisher | D26/94 |
| 5,283,725 | A | * | 2/1994 | Penza | 362/414 |
| D360,272 | S | * | 7/1995 | Chur | D26/94 |
| 6,149,283 | A | * | 11/2000 | Conway et al. | 362/236 |
| 6,474,847 | B1 | * | 11/2002 | Wu | 362/413 |
| D473,334 | S | * | 4/2003 | Conser | D26/94 |

OTHER PUBLICATIONS

"New Novelty Lamps", Home Lighting and Accessories, Sep. 1981.*

* cited by examiner

*Primary Examiner* — Sharon Payne

(57) ABSTRACT

A baseball cap lamp that is suitable for displaying and illuminating a baseball cap when the cap is not being worn includes a lamp shaft having a light socket and a cap stand carried by the lamp shaft at the light socket. An alternative illustrative embodiment of the baseball cap lamp includes a lamp shaft, an LED panel carried by the lamp shaft, a plurality of LEDs provided on the LED panel and a cap stand carried by the lamp shaft at the LED panel.

11 Claims, 8 Drawing Sheets

STRUCTURE TO SUPPORT, DISPLAY AND ILLUMINATE A BASEBALL CAP

FIELD OF THE INVENTION

The present disclosure relates to lamps. More particularly, the present disclosure relates to a structure that may be attached to a lamp so as to support, display and illuminate an actual baseball cap and to allow an actual baseball cap to function as a lampshade when said cap is not being worn.

BACKGROUND OF THE INVENTION

Baseball caps are popular among persons of all age groups. A typical baseball cap includes a dome-shaped cap body which fits on the head of the wearer and a bill which extends forwardly from the cap body. A business logo, slogan or sports team emblem is frequently stitched or printed on the front of the cap body above the bill. Additionally, the color scheme of the cap may reflect that of a business, sports team or other cause or institution. Therefore, baseball caps are a prominent way for persons to display loyalty to a business, sports team or other cause or institution.

When not being worn, baseball caps are commonly hung on a hat rack or placed on a flat surface. Some persons may desire to display the baseball cap in a prominent manner when the cap is not being worn. Therefore, a baseball cap lamp which may be free-standing and is suitable for displaying and illuminating a baseball cap when the cap is not being worn is needed.

SUMMARY OF THE INVENTION

The present disclosure is generally directed to a baseball cap lamp which may be free-standing and is suitable for displaying and illuminating a baseball cap when the cap is not being worn. An illustrative embodiment of the baseball cap lamp includes:

a lamp shaft having a light socket; and a cap stand carried by said lamp shaft at said light socket.

In another aspect, a cap stand interior in the cap stand may communicate with the light socket.

In yet another aspect, the cap stand may have a cage-shaped design.

In still another aspect, the cap stand may include a plurality of generally elongated, spaced-apart cap stand arms.

In another aspect, each of the cap stand arms may be outwardly-curved.

In a still further aspect, a generally flat cap supporting surface may be shaped in the cap stand arms.

In another aspect, the cap stand arms may join at the cap supporting surface.

In yet another aspect, the lamp shaft may extend from a lamp base.

An alternative illustrative embodiment of the baseball cap lamp includes:

a lamp shaft;

an LED panel carried by the lamp shaft;

a plurality of LEDs provided on the LED panel; and a cap stand carried by the lamp shaft at the LED panel.

BRIEF DESCRIPTION OF THE DRAWINGS

The disclosure will now be made, by way of example, with reference to the accompanying drawings, in which.

DETAILED DESCRIPTION OF THE PREFERRED EMBODIMENTS

The following detailed description is merely exemplary in nature and is not intended to limit the described embodiments or the application and uses of the described embodiments. As used herein, the word "exemplary" or "illustrative" means "serving as an example, instance or illustration". Any implementation described herein as "exemplary" or "illustrative" is not necessarily to be construed as preferred or advantageous over other implementations. All of the implementations described below are exemplary implementations provided to enable persons skilled in the art to make or use the lamp and are not intended to limit the scope of the embodiments of the disclosure which are defined by the claims. Furthermore, there is no intention to be bound by any expressed or implied theory presented in the preceding technical field, background, brief summary or the following detailed description.

Figure 1:
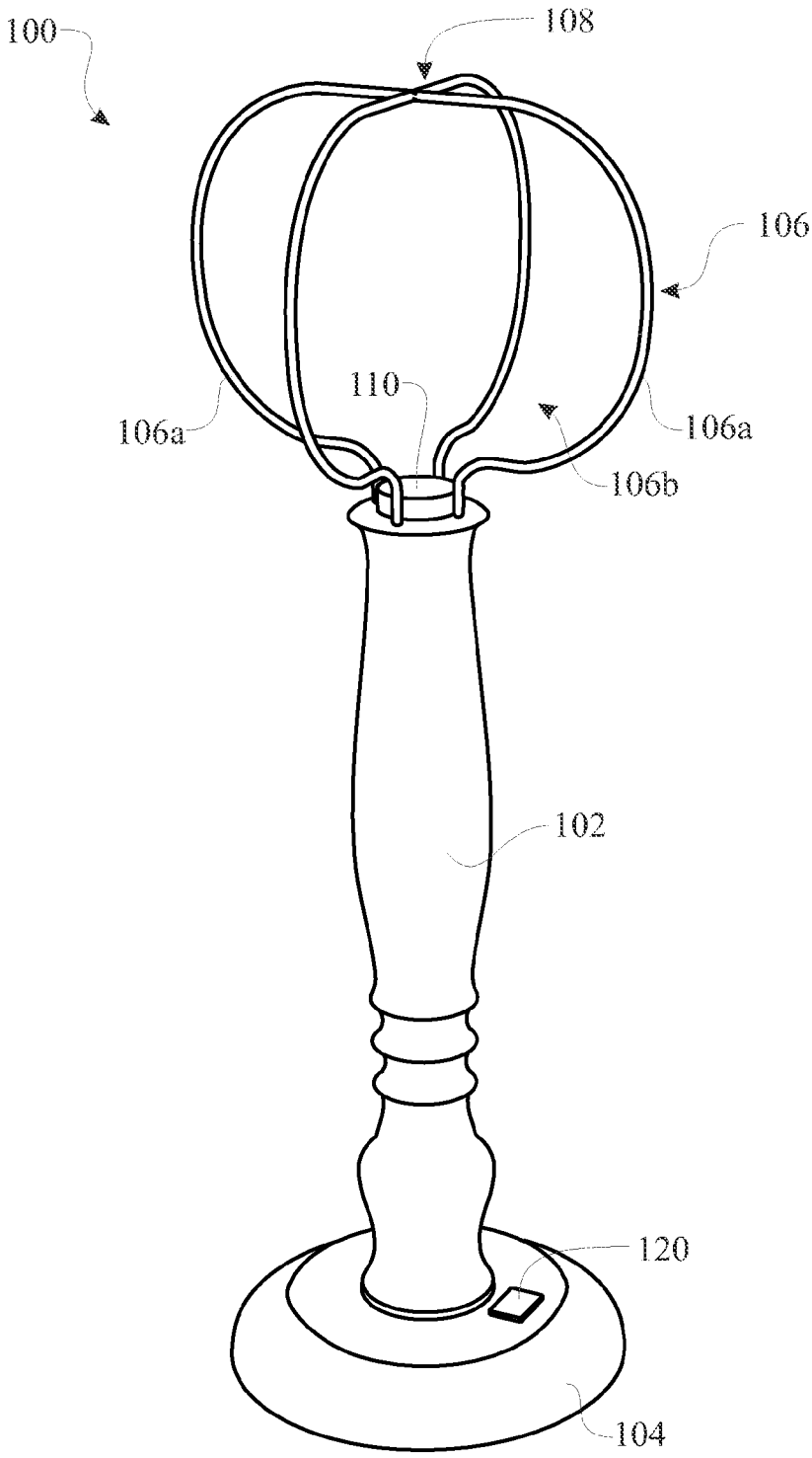
FIG. 1 is a front perspective view of an illustrative embodiment of the baseball cap lamp.
Figure 2:
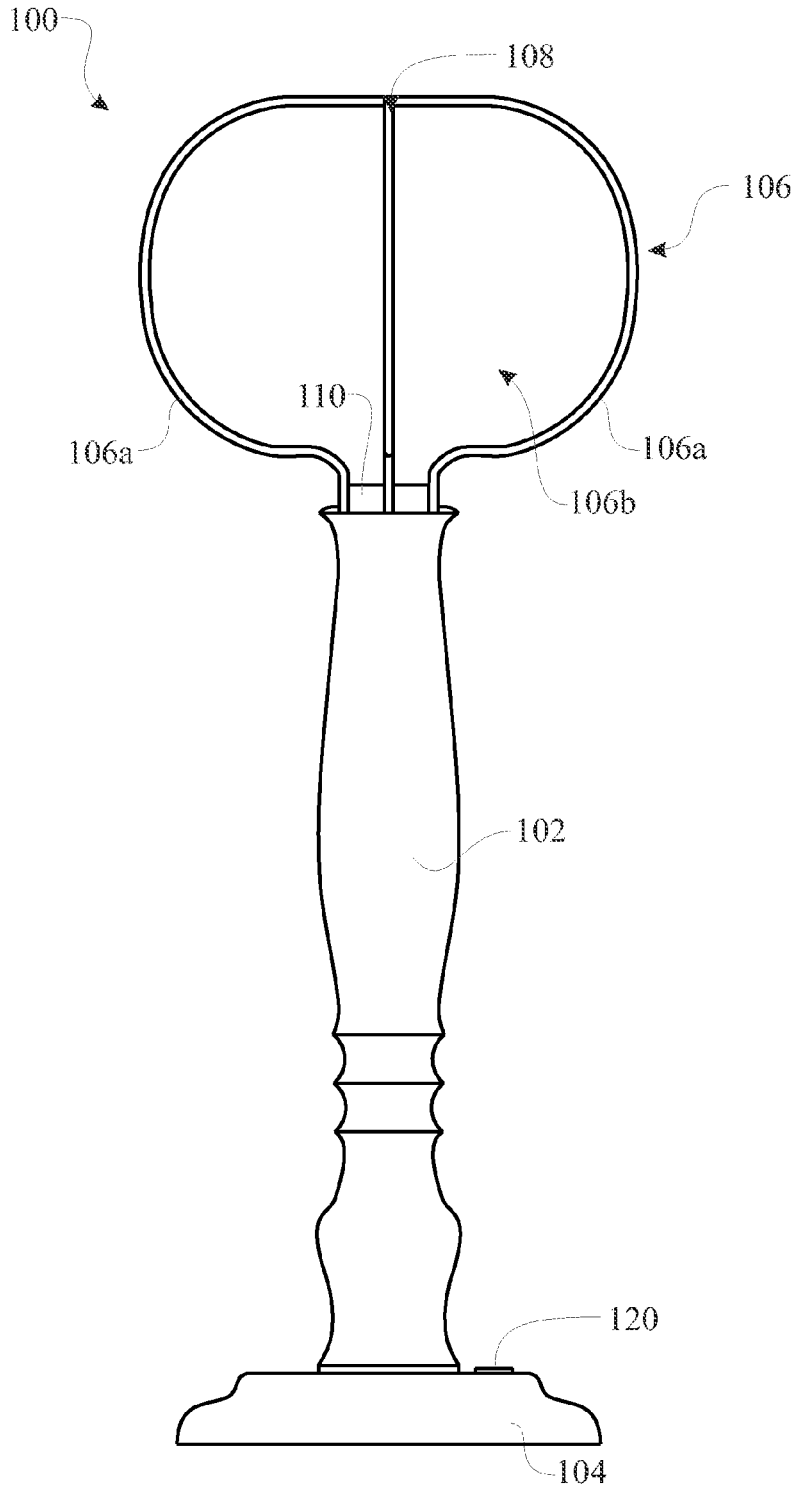
FIG. 2 is a side view of an illustrative embodiment of the baseball cap lamp.
Figure 3:
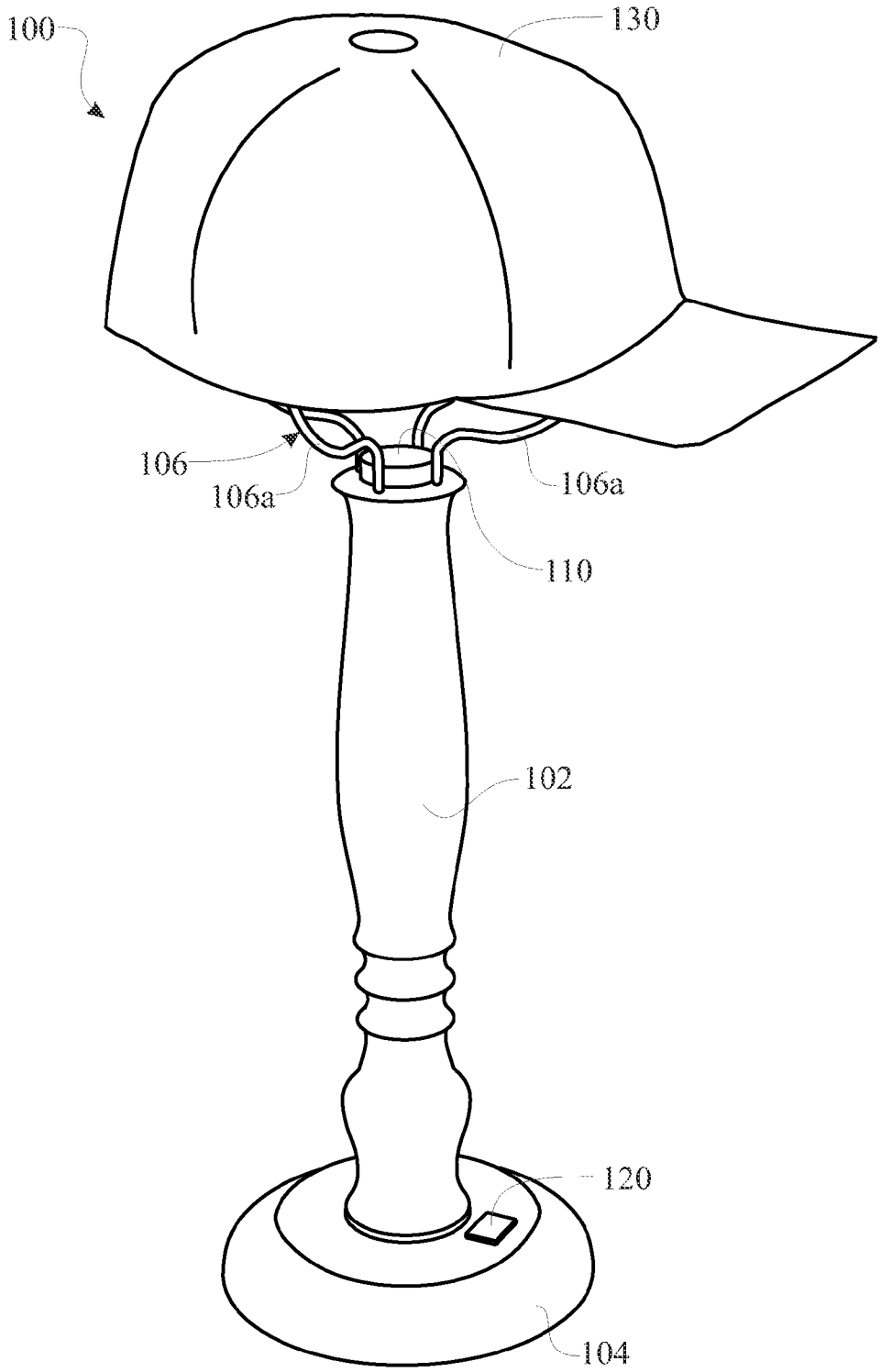
FIG. 3 is a perspective view of an illustrative embodiment of the baseball cap lamp, with a baseball cap placed on the lamp for display.
Figure 4:
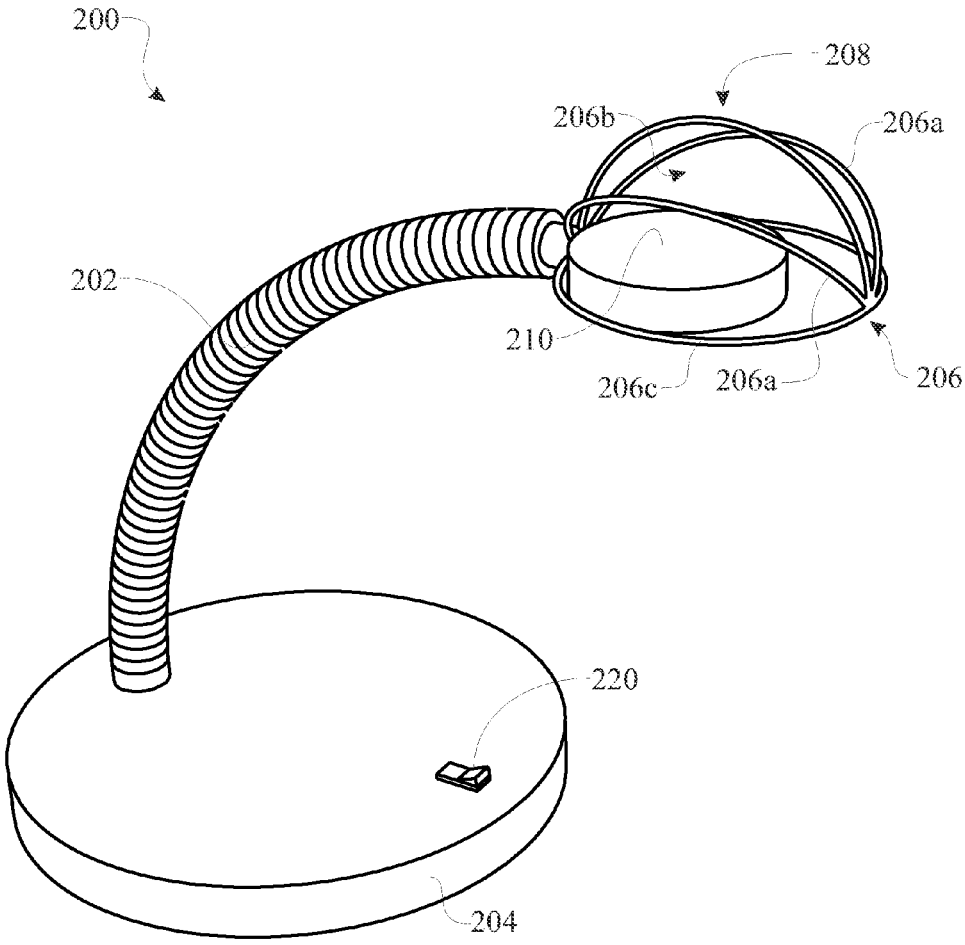
FIG. 4 is a perspective view of an alternative illustrative embodiment of the baseball cap lamp.
Figure 5:
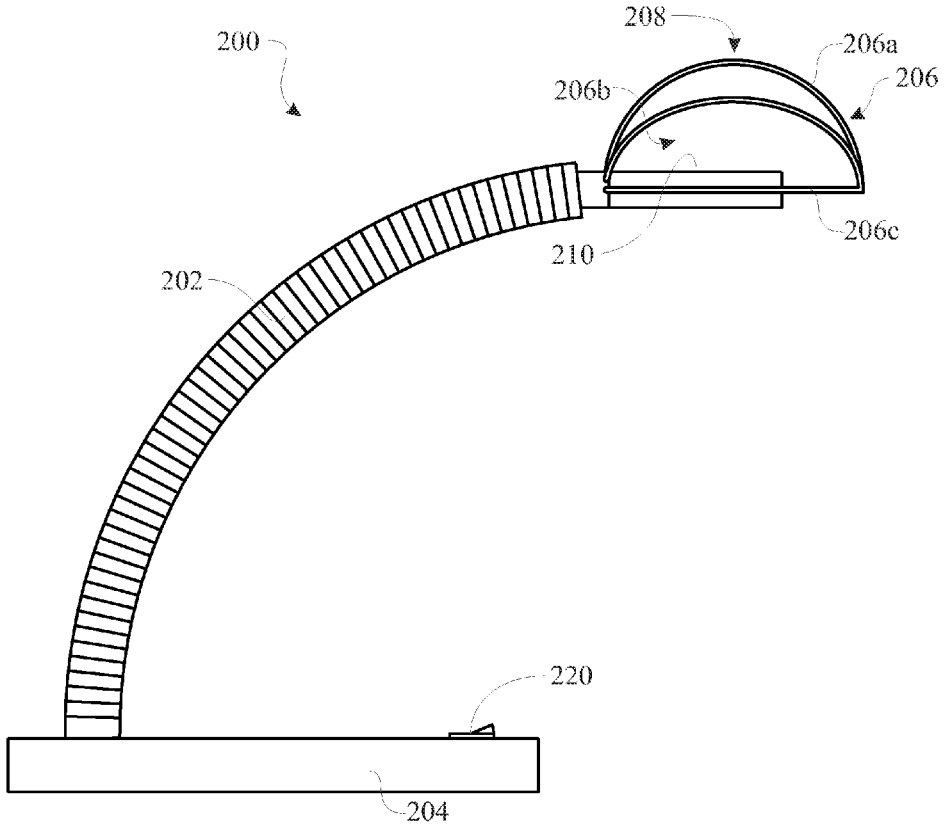
FIG. 5 is a side view of the baseball cap lamp illustrated in FIG. 4.
Figure 6:
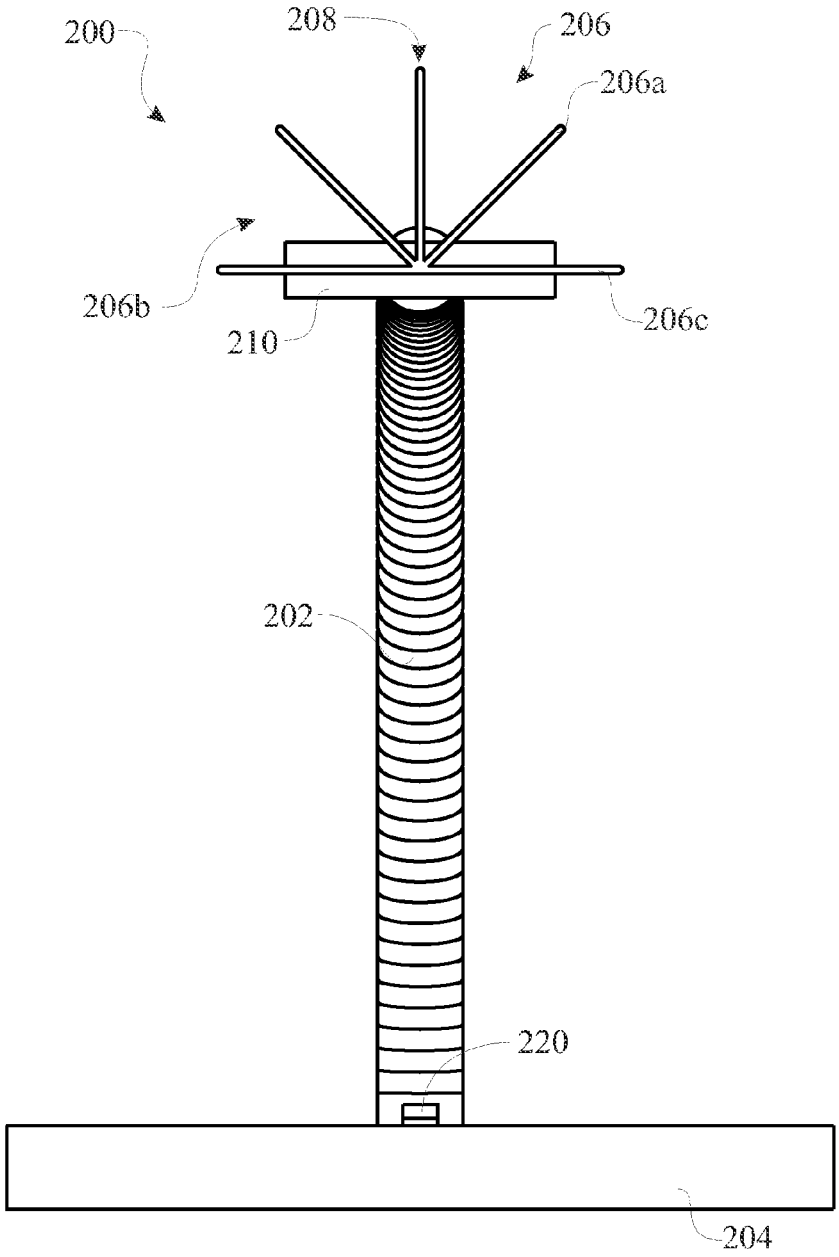
FIG. 6 is a front view of the baseball cap lamp illustrated in FIG. 4.

Referring initially to FIGS. 1-3 of the drawings, an illustrative embodiment of the baseball cap lamp, hereinafter lamp, is generally indicated by reference numeral 100. The lamp 100 includes a lamp shaft 102 which may be generally elongated and may have any desired decorative configuration. In some embodiments, the lamp shaft 102 extends from a lamp base 104. In other embodiments, the lamp shaft 102 may extend directly from a surface (not illustrated) such as a table top, for example and without limitation. The lamp base 104 may have a circular shape, as shown, or any suitable alternative shape.

A light socket 110 is provided in a distal or extending end of the lamp shaft 102. The light socket 110 is configured to receive an incandescent light bulb (not illustrated). A light switch 120 is provided on the lamp base 104, as illustrated, or alternatively, may be provided on the lamp shaft 102 or elsewhere on the lamp 1. The light switch 120 is electrically connected to the light socket 110 such as through wiring (not illustrated) which extends through the lamp base 104 and the lamp shaft 102. In some embodiments, an AC power cord (not illustrated) is electrically connected to the light switch 120 and extends from the lamp base 104. The AC power cord terminates in a standard AC outlet plug (not illustrated) which is adapted for insertion in a standard 120-volt electrical outlet (not illustrated). In some embodiments, the light switch 120 may be electrically connected to an alternative source of electrical power such as at least one battery (not illustrated), for example and without limitation. The battery or batteries may be contained in a battery compartment (not illustrated) provided in the lamp base 104.

A cap stand 106 is provided on the lamp shaft 102 generally adjacent to the light socket 110. In some embodiments, the cap stand 106 has a cage-shaped design and includes multiple, spaced-apart, outwardly-curved cap stand arms 106*a* which extend from the lamp shaft 102. The cap stand arms 106*a* join at a flattened cap supporting surface 108 and define a cap stand interior 106*b* which communicates with the light socket 110. The cap stand arms 106*a* of the cap stand 106 may be any suitable heat-resistant material such as metal, plexiglass or heat-resistant plastic, for example and without limitation. The cap stand 106 may have any alternative design or construction and shape which is suitable for supporting a baseball cap 130 (FIG. 3) in an upright position in use of the lamp 100, which will be hereinafter described.

As illustrated in FIG. 3, in typical use of the lamp 100, the lamp base 104 is placed on a flat supporting surface (not illustrated) such as a table top, for example and without limitation. A light bulb (not illustrated) is inserted in the light socket 110 and may extend into the cap stand interior 106*b* of the cap stand 106. A baseball cap 130 is placed over the cap stand 106. The outwardly-extended configuration of the cap stand arms 106*a* of the cap stand 106 maintains the baseball cap 130 in an outwardly-extended configuration. The light bulb (not illustrated) inserted in the light socket 110 may be illuminated by depression of the light switch 120. This, in turn, facilitates illumination and display of the baseball cap 130 as the baseball cap 130 remains on the cap stand 106.

Figure 7:
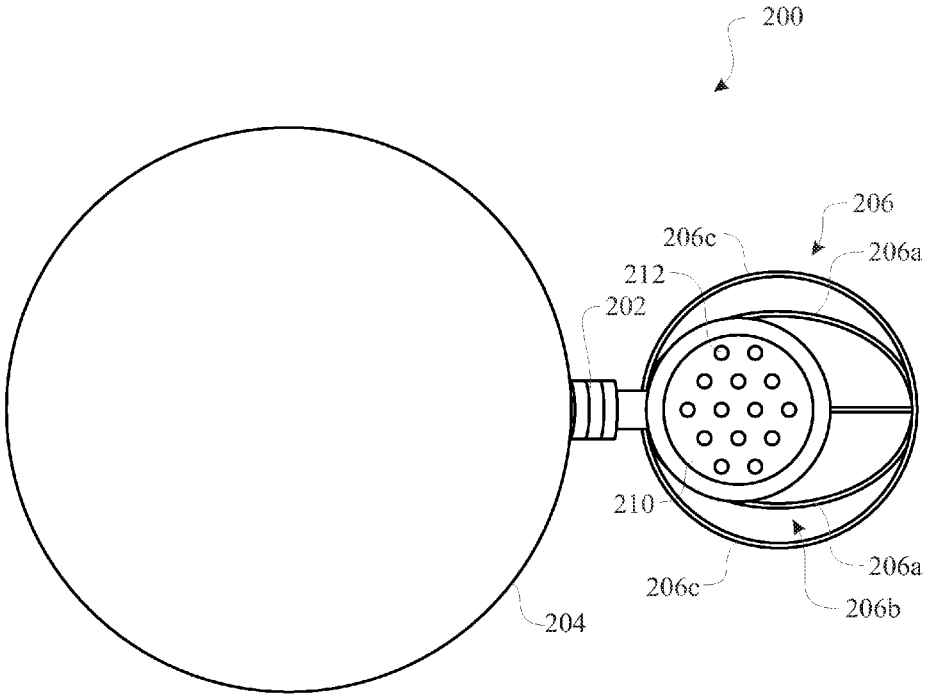
FIG. 7 is a bottom view of the baseball cap lamp illustrated in FIG. 4.

Referring next to FIGS. 4-8 of the drawings, an alternative illustrative embodiment of the baseball cap lamp 200 includes an elongated, flexible lamp shaft 202 which in some embodiments extends from a lamp base 204. In other embodiments, the lamp shaft 202 may extend from directly from a surface (not illustrated) such as a table top, for example and without limitation. The lamp shaft 202 may be a segmented-type shaft known by those skilled in the art. An LED panel 210 is provided on the distal or extending end of the lamp shaft 202 and is electrically connected to a light switch 220 which may be provided on the lamp base 204, the lamp shaft 202 or elsewhere on the lamp 200. As illustrated in FIG. 7, multiple LEDs 212 are provided on the LED panel 210 in a selected pattern. In some embodiments, an AC power cord (not illustrated) is electrically connected to the light switch 220 and extends from the lamp base 204. The AC power cord terminates in a standard AC outlet plug (not illustrated) which is adapted for insertion in a standard 120-volt electrical outlet (not illustrated). In some embodiments, the light switch 220 may be electrically connected to an alternative source of electrical power such as at least one battery (not illustrated), for example and without limitation. The battery or batteries may be contained in a battery compartment (not illustrated) provided in the lamp base 204.

A cap stand 206 is provided on the extending or distal end of the lamp shaft 202. In some embodiments, the cap stand 206 has a cage-shaped design and includes an annular cap stand base 206*c*. Multiple, semicircular, spaced-apart cap stand arms 206*a* span the cap stand base 206*c*. The cap stand base 206*c* and the cap stand arms 206*a* define a cap stand interior 206*b*. The outer surfaces of the cap stand arms 206*a* define a cap supporting surface 208. The cap stand arms 206*a* of the cap stand 206 may be any suitable heat-resistant material such as metal, plexiglass or heat-resistant plastic, for example and without limitation. The cap stand 206 may have any alternative design or construction and shape which is suitable for supporting a baseball cap 130 (FIG. 8) in an upright position in use of the lamp 200, which will be hereinafter described.

Figure 8:
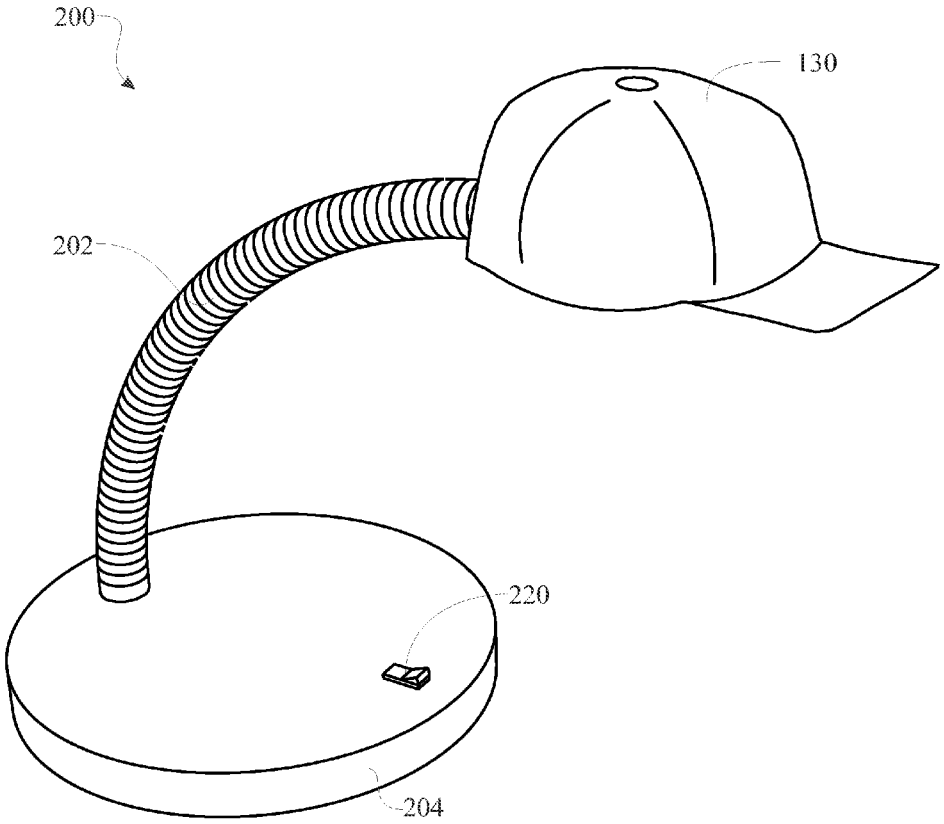
FIG. 8 is a perspective view of the baseball cap lamp illustrated in FIG. 4, with a baseball cap placed on the lamp for display.

As illustrated in FIG. 8, in typical use of the lamp 200, the lamp base 204 is placed on a flat supporting surface (not illustrated) such as a table top, for example and without limitation. A baseball cap 130 is placed over the cap stand 206. The cap stand arms 206*a* of the cap stand 206 maintain the baseball cap 130 in an extended configuration. The LEDs 212 (FIG. 7) on the LED panel 210 may be illuminated by depression of the light switch 220. This, in turn, facilitates illumination and display of the baseball cap 130 as the baseball cap 130 remains on the cap stand 206. The flexible lamp shaft 202 may be bended to place the cap stand 206 in any suitable position.

What is claimed is:

1. A structure to support, display and illuminate a wearable cap allowing an actual cap to function as a lampshade when it is not being worn comprising:

A) the structure comprising: an upper surface or plurality of surfaces that generally conform to the inner surface of the wearable cap with sufficient points of contact to inner surface of said cap to display and support said cap;

B) a means to affix said structure to a lamp so that when said cap is mounted on said structure said cap will shade and direct the light produced by said lamp; and C) the wearable cap is removably supported by the upper surface or the plurality of upper surfaces.

2. The structure of claim 1 further comprising a cap stand interior in said structure and communicating with a light socket.

3. The structure of claim 1 wherein said structure has a cage-shaped design.

4. The structure of claim 2 wherein said structure comprises a plurality of generally elongated, spaced-apart cap stand arms.

5. The structure of claim 4 wherein each of said cap stand arms is outwardly-curved.

6. The structure lamp of claim 4 further comprising a generally flat cap supporting surface shaped in said cap stand arms.

7. The structure of claim 6 wherein said cap stand arms join at said cap supporting surface.

8. The structure of claim 1 wherein said structure comprises an annular cap stand base carried by a lamp shaft and a plurality of spaced-apart, semicircular cap stand arms spanning said cap stand base.

9. The structure of claim 1 further comprising a cap stand interior provided in said structure and wherein said LED panel is disposed in said cap stand interior.

10. The structure of claim 1 wherein the structure further comprises a lamp base and wherein a lamp shaft extends from said lamp base.

11. The structure of claim 10 wherein said lamp shaft is flexible.

* * * * *